US007869614B2

(12) United States Patent
Gabathuler

(10) Patent No.: US 7,869,614 B2
(45) Date of Patent: Jan. 11, 2011

(54) FIXING DEVICE FOR OPERATING ELEMENTS OF HEARING DEVICES OR HEARING AIDS

(75) Inventor: Bruno Gabathuler, Stafa (CH)

(73) Assignee: Phonak AG, Stafa (CH)

( * ) Notice: Subject to any disclaimer, the term of this patent is extended or adjusted under 35 U.S.C. 154(b) by 1441 days.

(21) Appl. No.: 11/263,095

(22) Filed: Oct. 31, 2005

(65) Prior Publication Data

US 2007/0098196 A1 May 3, 2007

(51) Int. Cl.
*H04R 25/00* (2006.01)

(52) U.S. Cl. ..... 381/329; 381/322; 381/324; 381/328

(58) Field of Classification Search ..... 381/322, 381/324, 328; 439/527–576; 248/538
See application file for complete search history.

(56) References Cited

U.S. PATENT DOCUMENTS 2,687,862 A * 8/1954 Crowther ..... 248/27.3
3,549,828 A * 12/1970 Lang ..... 381/322
4,053,082 A * 10/1977 Ullman ..... 220/3.6
4,835,833 A 6/1989 McDonald
5,157,371 A 10/1992 Sundquist et al.
5,201,008 A * 4/1993 Arndt et al. ..... 381/323
6,028,502 A * 2/2000 McSwiggen ..... 338/167

* cited by examiner

*Primary Examiner*—Suhan Ni
*Assistant Examiner*—Jasmine Pritchard
(74) *Attorney, Agent, or Firm*—Pearne & Gordon LLP

(57) ABSTRACT

The present invention provides a fixing device for receiving and attaching operating elements to the faceplate of hearing devices or hearing aids, whereas the operating elements comprising connectors for the electrical connection to further electric or electronic components of the hearing device or hearing aid, further comprising a bush having a slot continuously extending from one end to the other end of said bush. Such a bush may on one hand be shifted from the outside onto a defined area of the operating element and on the other hand be inserted into an opening of the faceplate with an opening diameter dimensioned according the outer diameter of the bush. The clamping effect thus acts both onto the bush and the operating element, thereby fixing reliable both the bush and the operating element within the faceplate. The bush or the operating element respectively may thus easily non-destructively be removed from the faceplate by pulling it out of the opening in the faceplate.

12 Claims, 4 Drawing Sheets

FIXING DEVICE FOR OPERATING ELEMENTS OF HEARING DEVICES OR HEARING AIDS

BACKGROUND OF THE INVENTION

This invention relates to a fixing device for receiving and attaching operating elements to the faceplate of hearing devices or hearing aids.

The present invention further relates to a hearing device or hearing aid with a faceplate and a housing shell arranged to the faceplate, the faceplate comprising at least one opening for the receiving of an operating element.

The present invention further relates to a method for attaching operating elements with the faceplate of hearing devices or hearing aids.

Hearing devices or hearing aids usually have operating elements to be operated manually from the outside such as switches, turn-switches and push-buttons. Those operating elements will have to be handled during operation of the devices and are therefore arranged at the faceplate of the respective devices, e.g. of in-the-ear hearing devices that are arranged within the ear canal for its use. The operating elements will have to be electrically connected to the electrical or electronic components of the respective hearing device or hearing aid, usually by using leads or wires.

As the faceplates are regularly individually shaped or made for the respective user and the ratio of returns of such hearing devices or hearing aids is relatively high because most problems relating to the compatibility or wearing comfort occur during the first wearing or fitting phase, most of the components of the hearing device or hearing aid should be able to be re-used again. That concern electronic components attached electrically to the faceplate on one hand and operation elements if applicable on the other hand.

The operating elements will usually be plugged-in from the outside into the faceplate and connected to the faceplate by adhesives. The disadvantage of this easy kind of attachment of the operating elements is that the operating elements cannot be non-destructive disengaged from the faceplate and thus may not be re-used. Furthermore, the hardening of the adhesive has to be waited before further processing, as the operating element concerned could be unintentionally displaced or loosen from its destined position. A pollution of the operating element may not be excluded by the adhesive and thus may lead to a derogation of the mechanical and/or electrical function of the operating element.

An alternative solution for the mechanical attachment especially of potentiometers for above described hearing devices is known from U.S. Pat. No. 4,835,833. A metal ring will thus be shifted onto the lower section of the housing of the potentiometer and will be inserted together with the potentiometer into an opening of the faceplate having a respective receiving diameter. Circumferential arranged rims at the metal ring serve as fixing means to the faceplate for both potentiometer and the metal ring. Thus, a stable connection between the potentiometer and the faceplate will be achieved without the use of adhesives. However, this connection, as well as the already mentioned connection using adhesives, may practically not be non-destructively disengaged afterwards.

A further disadvantage of all commonly known solutions is that the connecting wiring of the operating elements with electronic components will have to be disengaged by time-consuming, manual de-soldering. The faceplate has therefore first to be detached from the housing shell of the hearing device, as the operating elements may not be non-destructively detached from the faceplate.

U.S. Pat. No. 5,157,371 is also showing a further device for the attachment of a potentiometer to the faceplate of a hearing device whereas the potentiometer is plugged-in from the outside into the faceplate and may afterwards be detached if required. Therefore, an additional adapter will be connected to the faceplate with electrical contacts for resiliently receiving electrical contacts of the potentiometer. This plug-in connection for establishing the electrical contact disadvantageously is prone to corrosion and pollution that may lead to malfunctions. Furthermore, the complex structure of the adapter may practically not be removed from the faceplate without extraordinary effort.

SUMMARY OF THE INVENTION

It is an object of the present invention to provide a device for the easy and detachable connection of operating elements to the faceplate of hearing devices or hearing aids that allows a non-destructive detachment of the operating elements from the faceplate. It is a further object of the present invention to provide such a device that allows the detachment of the operating elements from the faceplate of hearing devices or hearing aids without the need of detaching the electrical connections from those operating elements with other electrical or electronic components of the hearing device or hearing aid.

The present invention provides a fixing device for receiving and attaching operating elements to the faceplate of hearing devices or hearing aids, whereas the operating elements comprising connectors for the electrical connection to further electric or electronic components of the hearing device or hearing aid, further comprising a bush having a first slot continuously extending from one end to the other end of said bush. Such a bush may on one hand be shifted from the outside onto a defined area of the operating element and on the other hand be inserted into an opening of the faceplate with an opening diameter dimensioned according the outer diameter of the bush. The clamping effect thus acts both onto the bush and the operating element, thereby fixing reliably both the bush and the operating element with the faceplate. The bush or the operating element respectively may thus easily be non-destructively removed from the faceplate by pulling it out of the opening of the faceplate.

In one embodiment, the bush has a substantially round cross section. The bush may thus be easily produced and the opening in the faceplate may be produced either by drilling a hole or by forming the opening with narrow tolerances directly within the faceplate. The operating elements themselves, such as potentiometers that are used for the manual control of the sound level of the hearing device, have commonly a circular cross section.

In another embodiment, recesses or elevations are arranged on the outside of the bush. The recesses or elevations may be ribs (8) or a third slot (14) arranged parallel to the longitudinal axis of the bush. Those recesses or elevations result in a stable pressing between bush and faceplate and thus result finally in a stable pressing seat of the bush in the faceplate. An independent or unintentional movement of the bush from its original position will therefore be prevented. Those recesses or elevations further provide an anti-twist security of the bush, e.g. the bush may not be twisted after its insertion into the faceplate.

In a further embodiment, the first slot is arranged parallel with respect to the longitudinal axis of the bush. The bush may thus be produced very easily and provides excellent clamping or pressing capabilities. It is understood for a person skilled in the art to provide another shape of the first slot, i.e. helically inclined directed or curved straight or inclined directed first slots. This would on one hand extend the length of the first slot and on the other hand prevent the easy intrusion of foreign objects from the outside.

In a further embodiment recesses or elevations are arranged on the inside of the bush. The recesses or elevations may be ribs (7) or a second slot (12) arranged parallel to the longitudinal axis of the bush. Those recesses or elevations result in a stable pressing between operating element and faceplate and thus result finally in a stable pressing seat of the operating element in the faceplate. An independent or unintentional movement of the operating element from its original position will therefore be prevented. The cross-section of the recesses or elevations may be round or angular shaped, preferably having a triangular shape.

Several recesses or elevations may be arranged one after each other. Those recesses or elevations further provide an anti-twist security of the operation element, e.g. the operation element may not be twisted after its insertion into the faceplate. This is of great importance especially in case of turn-switches used as operation elements.

In a further embodiment, snap or stop elements are arranged at one end of the bush radially directed to the outside. Those elements serve as positioning elements for the bush in relation to the faceplate. They may define and preserve an exactly defined insertion depth of the operation element. Such a stop element further prevents the operation element from being inserted far beyond the defined insertion depth or being pushed completely through the opening of the faceplate into the inside of the hearing device or hearing aid.

In a further embodiment, the external diameter of the bush is greater than the largest diameter of an operating element to be inserted into said bush. An advantage of this embodiment is the fact that the operation element without the bush may be pushed through the opening from outside of the faceplate. Thus, the operating element may be connected by one or more wires with other electronic components that are arranged at the inside of the hearing device or hearing aid and may be detached from the faceplate without detaching those wires or connections. This is of great advantage in case if the wires or leads are soldered with the other electronic components or the operating element respectively, as cutting and subsequent soldering will be prevented.

In another embodiment the bush is made of an at least partial elastically material. The material may be a plastic material. An elastic but form stable material is of great advantage to provide optimal clamp action of the bush. Plastic material provides on one hand an easy production of the shape and on the other hand a cost effective mass production with a high degree of precision. It is understood that other materials, such as metal, could also be used for the bush.

The present invention further provides a hearing device or hearing aid with a faceplate (l) and a housing shell (16) arranged to the faceplate (1), the faceplate (1) comprising at least one opening for the receiving of an operating element, whereas the opening is formed as an continuous opening for receiving a fixing device for receiving and attaching operating elements to the faceplate of hearing devices or hearing aids, whereas the operating elements comprising connectors for the electrical connection to further electric or electronic components of the hearing device or hearing aid, further comprising a bush having a first slot continuously extending from one end to the other end of said bush.

The present invention further provides a method for attaching operating elements with the faceplate of hearing devices or hearing aids, comprising the steps of connecting electrically the operating device with the electronic components of the hearing device or hearing aid;

conducting the operating device from the inside of the faceplate through an opening of the faceplate to the outside of the faceplate;

inserting a fixing device or the operating element from the outside into said opening of the faceplate; and inserting the operating element from the outside into said fixing device.

DESCRIPTION OF THE DRAWINGS

For purpose of facilitating and understanding of the invention, there is illustrated in the accompanying drawings preferred embodiments thereof to be considered in connection with the following description. Thus the invention may be readily understood and appreciated.

DESCRIPTION OF A PREFFERED EMBODIMENT

Figure 1:
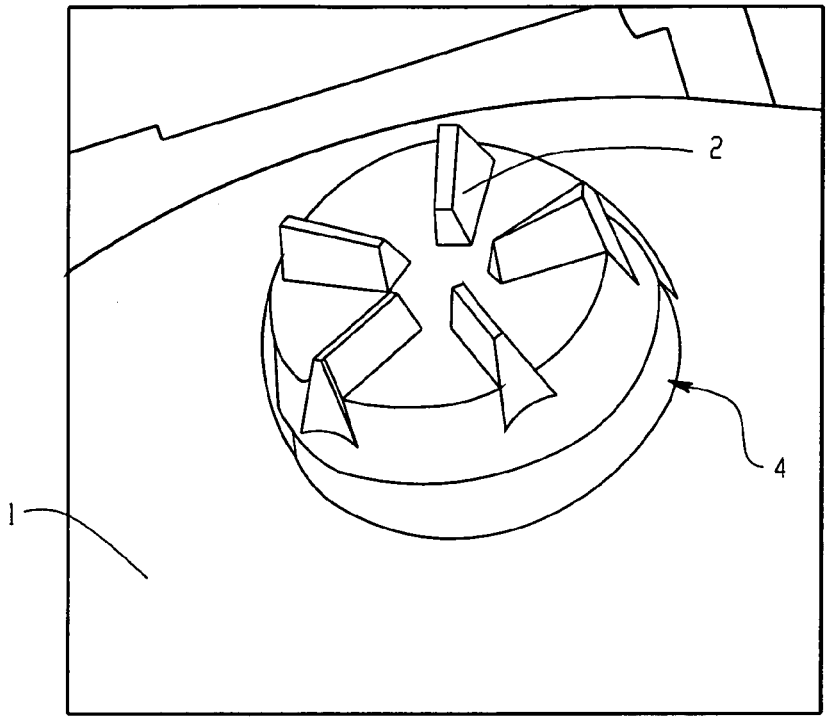
FIG. 1 is the view of a faceplate with an operating element in form of a turn-switch or potentiometer respectively attached by a fixing device according the present invention.
Figure 2:
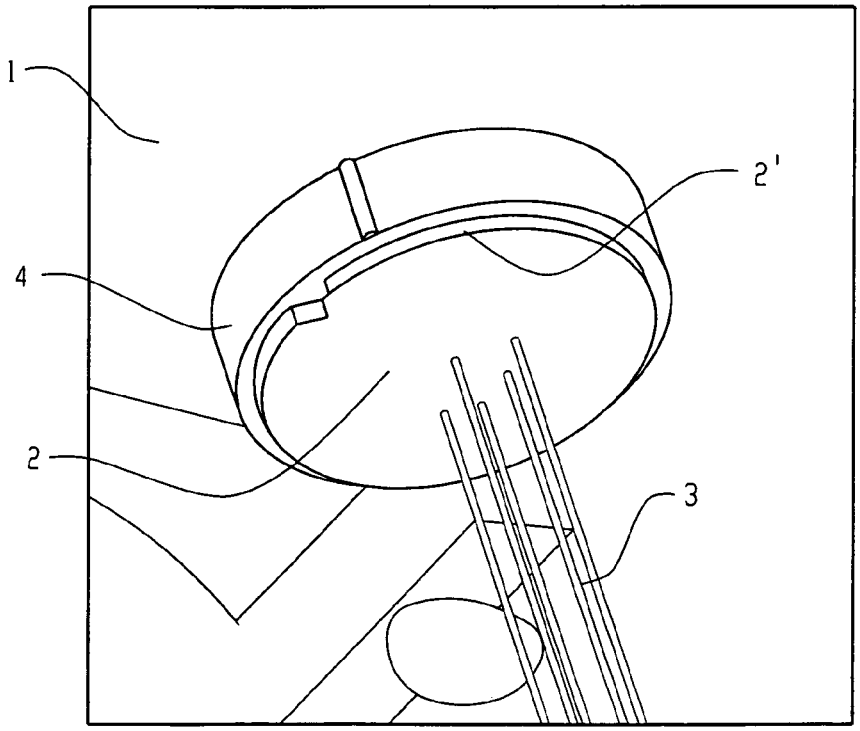
FIG. 2 is the view from inside of the faceplate onto the underside of the operating element according FIG. 1.

Referring to FIG. 1, the top view onto an area of a faceplate 1 of an in-the-ear hearing aid 50 shows the operating element in form of a turn-switch 2 or potentiometer respectively, that will be manually handled from the outside of the hearing aid 50. The turn-switch 2 comprises for instance a potentiometer that is connected by leads 3 with other electronic components (not shown in the figures) as can be seen in FIG. 2.

A bush 4 is inventively provided for the attachment of the operating element 2 with the faceplate 1, the bush 4 surrounding the bottom area 2' of the operating element 2. An opening 5 is provided in the surface of the faceplate 1 so that the bush 4 together with the operating element 2 may be inserted into this opening 5. The bush 4 may consist of plastic or alternatively be made out of metal.

Figure 3:
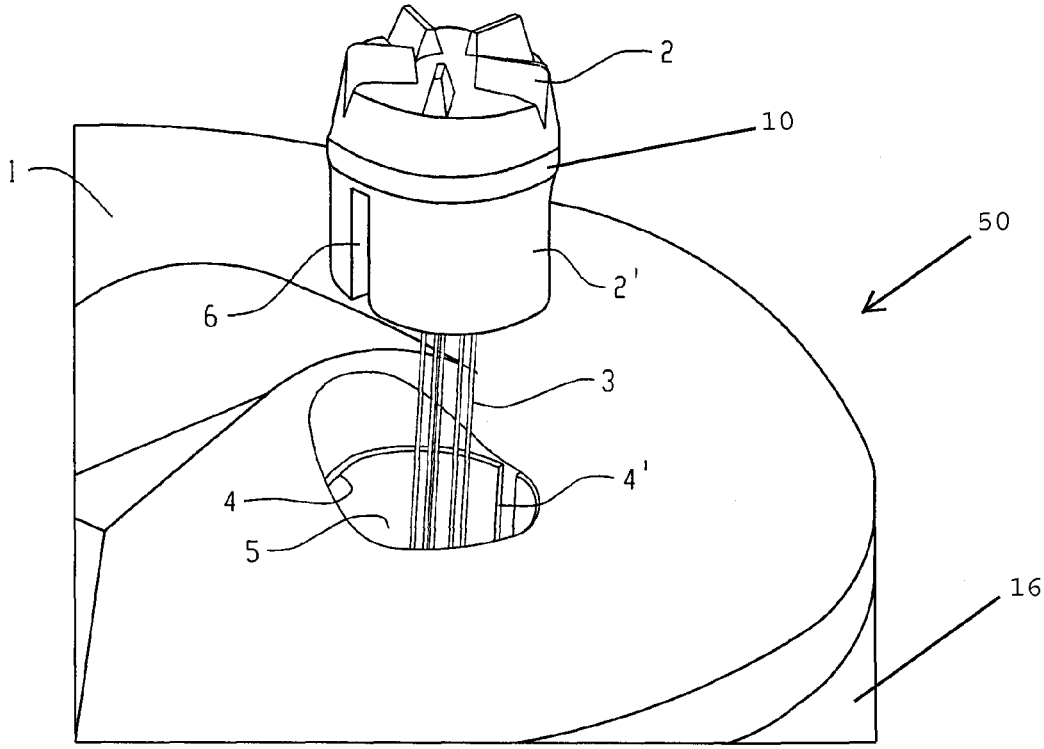
FIG. 3 is the view of the operating element of FIG. 1 unplugged in direction of the outside of the faceplate.

Referring to FIG. 3, the top view onto the faceplate 1 of the hearing aid 50 shows the bush 4 inserted into the opening 5. The operating element 2 is positioned outside and above this opening 5 for being inserted into the faceplate 1. The leads 3 are already led through the opening 5 into the inside of the hearing aid 50 and are connected there with further common electronic components of the hearing aid 50.

The operating element 2 may now be inserted into the bush 4 for being clamped and fixed there. The clamping will be realized by a respective dimensioning of the bush 4 and the lower section 2' of the operating element 2 respectively. The first slot 4' of the bush 4 supports an easy insertion of the bush 4 into the opening 5 and enables a slight enlargement of the bush 4 during the insertion of the operating element 1 into the bush 4, thus clamping the bush 4 against the inner wall of the opening 5 of the faceplate 1.

For an exact positioning of the operating element 2 and to prevent any unintentional or self-dependent movement or rotating of the operating element 2 around its longitudinal axis, grooves 6 are arranged at the outer surface of the lower section 2' of the operating element 2 parallel to the longitudinal axis of the operating element 2. Appropriate shaped ribs 7 engage into those grooves 6, thereby positioning the operating element 2 in relation to the bush 4 in an exactly defined situation.

Figure 4:
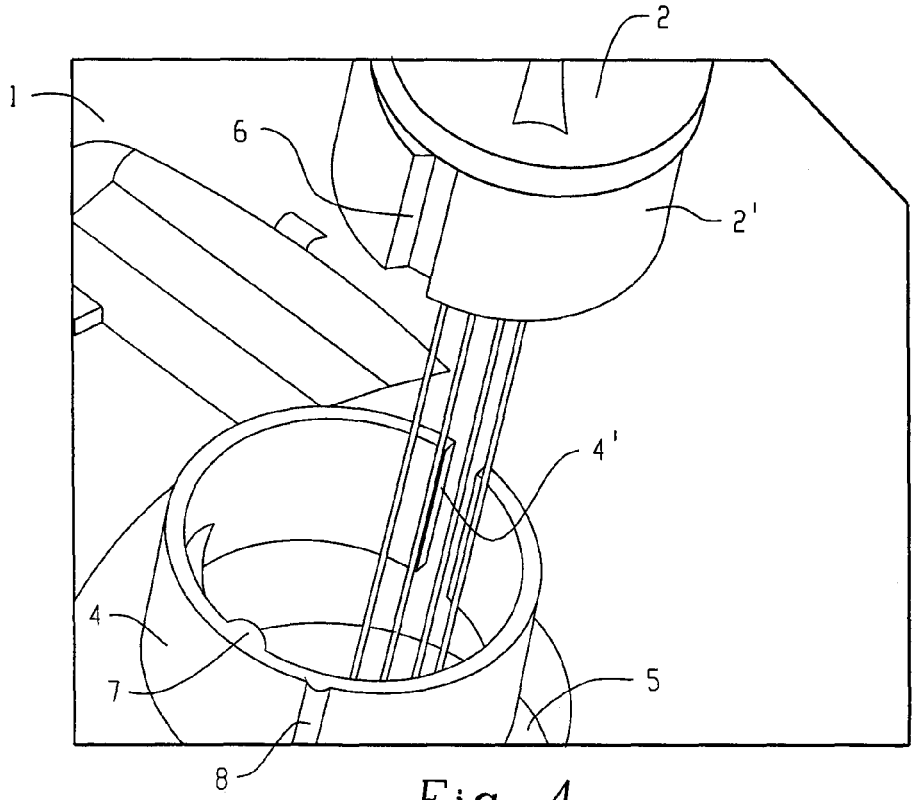
FIG. 4 is the view of the operating element and the fixing device unplugged from the faceplate.

The bush 4 comprises further ribs 8 on its outer surface as shown in FIG. 4. Those further ribs 8 enable in interaction with grooves formed within the opening 5 a defined positioning of the bush 4 relative to the faceplate 1.

The bush 4 may further have snap or stop elements 10 arranged transverse protruding to the outside with respect to the longitudinal axis at one end of the bush 4 that may be brought into contact against noses arranged within the opening 5. A defined insertion depth of the bush 4 into the faceplate 1 may thus be provided to achieve an exact depth positioning of the bush 4 or the operating element 2 respectively. Sealing or packing may be arranged in this area of the snap or stop elements 10 to prevent the intrusion of dampness or dust by the opening between the bush 4 and the opening 5.

The bush 4 is forming an interference fit between itself and the faceplate 1 or the operating element 2 respectively by use of corresponding geometrical dimensions. This enables the non-destructive detachment of the operating element 2 and bush 4 from the faceplate 1 at any later date. In a further embodiment, the bush 4 may be fixed to the opening 5 by use of adhesives and concurrently sealing the gap between the bush 4 and the opening 5.

Figure 5:
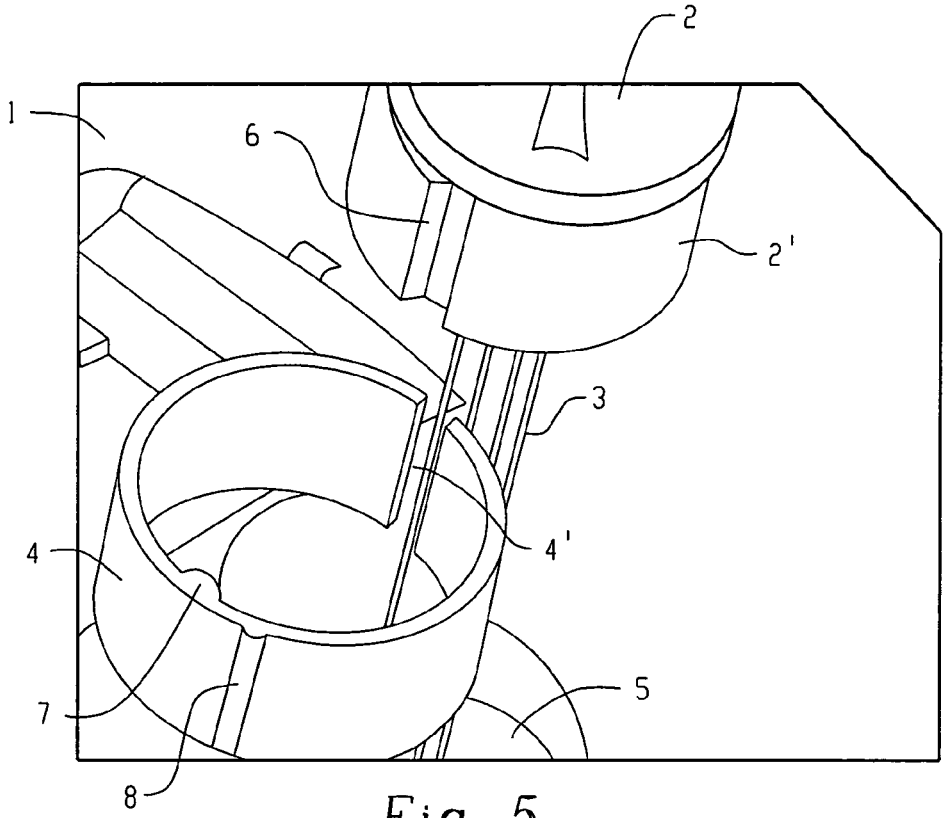
FIG. 5 is the view according FIG. 4 with the fixing device separated from the operating element or its connecting wires respectively.

Referring to FIG. 5, the detachment of the bush 4 from the operating element 2 is shown, without the need of detaching the leads 3 from the operating element 2. The leads 3 may be led through the first slot 4' of the bush 4 and thus the bush 4 may be removed.

Figure 6:
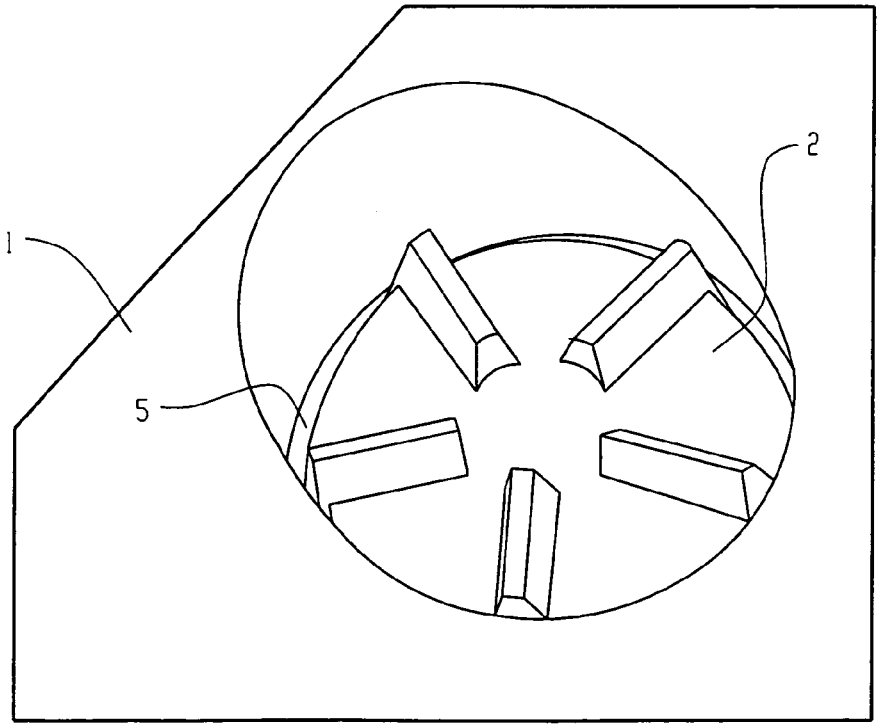
FIG. 6 is the view of the operating element according FIG. 1 pushed through the opening of the faceplate into the inside of the hearing device.
Figure 7:
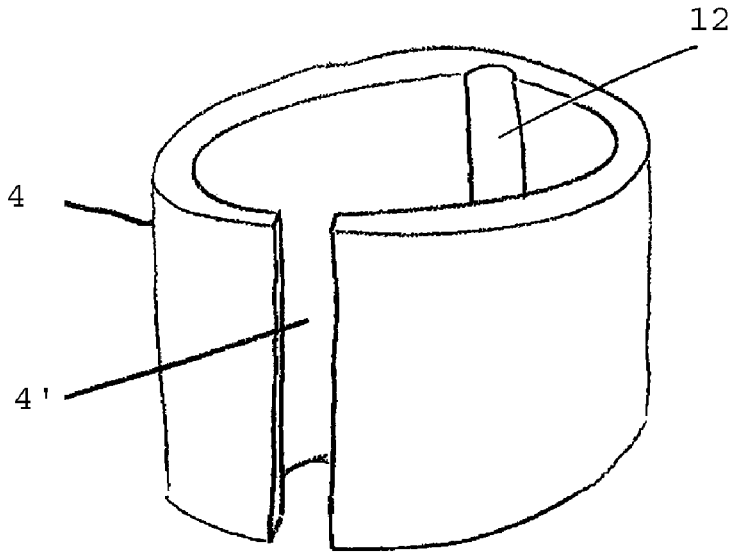
FIG. 7 is a view of a bush of the fixing device with a recess on the inside of the bush.
Figure 8:
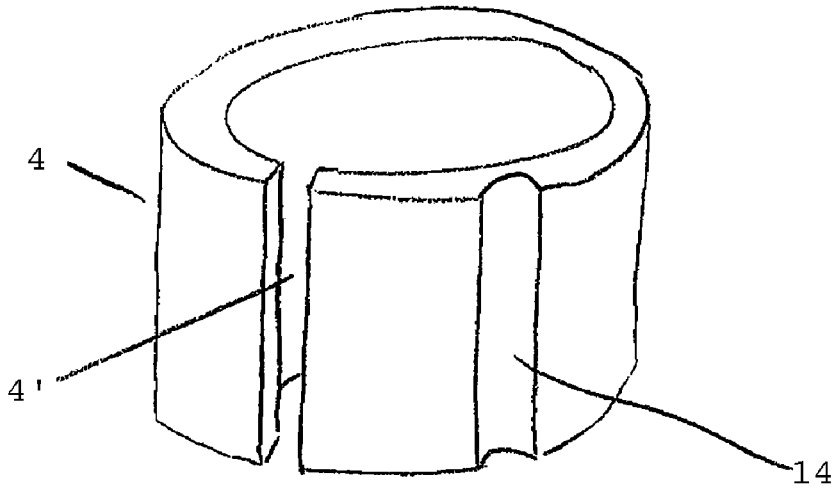
FIG. 8 is a view of a bush of the fixing device with a recess on the outside of the bush.

With the bush 4 removed, the operating element 2 may easy be pushed through the opening 5 into the inside of the hearing aid 50 or into the direction of any further electronic components respectively, as the greatest external diameter of the operating element 2 is smaller than the inner diameter of the opening 5, as can be seen in FIG. 6. Therefore the destruction of the faceplate 1 may be omitted and the leads 3 may leave connected with the electronic components and the operating element 2 to be re-used in another hearing aid 50 or another faceplate 1.

I claim:

1. A fixing device for receiving and attaching an operating element to a faceplate of a hearing device or a hearing aid, whereas the operating element comprises connectors for electrical connection to a further electric or electronic component of the hearing device or hearing aid, further comprising a bush having a first slot continuously extending from one end to another end of said bush wherein the connectors are configured to be removably inserted in a radial direction from an outside of the bush through the first slot, wherein the bush includes an inner diameter and an outer diameter, wherein the inner diameter is configured for surrounding the operating element; and wherein the first slot extends in a cross-section between the inner diameter of the bush and the outer diameter of the bush.

2. The fixing device according to claim 1 wherein the bush has a substantially round cross section.

3. The fixing device according to claim 1 with a recess or elevation arranged on an outside of the bush.

4. The fixing device according to claim 3 whereas the recess or elevation is a rib or a third slot arranged parallel to the longitudinal axis of the bush.

5. The fixing device according to claim 1 whereas the first slot is arranged parallel with respect to a longitudinal axis of the bush.

6. The fixing device according to claim 1 with a recess or elevation arranged on an inside of the bush.

7. The fixing device according to claim 6 whereas the recess or elevation is a rib or a second slot arranged parallel to the longitudinal axis of the bush.

8. The fixing device according to claim 1 with a snap or stop element arranged at one end of the bush radially directed to an outside of the bush.

9. The fixing device according to claim 1 with an external diameter of the bush being greater than a largest diameter of an operating element to be inserted into said bush.

10. The fixing device according to claim 1 whereas the bush is made of an at least partial elastically material.

11. The fixing device according to claim 10 whereas the material is a plastic material.

12. A method for attaching an operating element to a faceplate of a hearing device or a hearing aid, comprising the steps of:

connecting electrically the operating element with an electronic component of the hearing device or the hearing aid using connectors of the operating element;

conducting the operating element from an inside of the faceplate through an opening of the faceplate to an outside of the faceplate;

inserting the connectors through a first slot of a bush of a fixing device wherein the connectors are inserted in a radial direction from outside of the bush;

inserting the fixing device for receiving and attaching the operating element from the outside into said opening of the faceplate wherein the fixing device includes the bush having the first slot continuously extending from one end to another end of the bush; and inserting the operating element from the outside of the faceplate into said fixing device, wherein the first slot of the bush is configured to enable a slight enlargement of the bush after the operating element and the bush are inserted into the faceplate.

* * * * *